US005976285A

United States Patent [19]

McKee

[11] Patent Number: 5,976,285

[45] Date of Patent: Nov. 2, 1999

[54] METHOD OF MANUFACTURING A DOWNHOLE ELECTRICAL CABLE

[75] Inventor: Peter Martin McKee, Monymusk, United Kingdom

[73] Assignee: Wood Group Production Technology Limited, Aberdeen, United Kingdom

[21] Appl. No.: 08/977,863

[22] Filed: Nov. 25, 1997

[30] Foreign Application Priority Data

Nov. 28, 1996 [GB] United Kingdom ..... 9624738

[51] Int. Cl.[6] ..... B65H 81/06

[52] U.S. Cl. ..... 156/54; 156/203; 254/134.3 R

[58] Field of Search ..... 156/293, 294, 156/201, 203, 200, 199, 196, 423, 466, 465, 461, 459, 443, 54; 254/134.3 R, 134.3 CL; 29/241

[56] References Cited

U.S. PATENT DOCUMENTS

| | | | |
|---|---|---|---|
| 2,286,781 | 6/1942 | Abramson et al. | 254/134.3 R |
| 2,360,237 | 10/1944 | Kent | 254/134.3 CL |
| 2,402,172 | 6/1946 | Macy | 254/134.3 CL |
| 2,710,273 | 6/1955 | Hollingsworth | 29/434 |
| 2,975,087 | 3/1961 | Donald | 228/125 |
| 4,090,573 | 5/1978 | Rankin | 175/45 |

FOREIGN PATENT DOCUMENTS

| | | |
|---|---|---|
| 1 465 707 | 2/1977 | United Kingdom . |
| 2 250 385 | 3/1992 | United Kingdom . |

*Primary Examiner*—Francis J. Lorin
*Attorney, Agent, or Firm*—Ratner & Prestia

[57] ABSTRACT

A method of manufacturing a downhole electrical cable is described. The method comprises arranging an elongate member adjacent to a flat elongate sheet of material, where the length of the elongate member is greater than the length of the flat elongate sheet. The elongate sheet is then formed into a cylindrical shape around the elongate member, and the adjacent longitudinal edges of the cylindrical shape are joined, preferably by seam welding, to form the elongate sheet into a tube with an end of the elongate member adjacent each end of the -tube. Thereafter, an elongate conductor is connected to one end of the elongate member, and the other end of the elongate member is pulled to draw the elongate conductor through the tube until the elongate member is removed from the tube and the elongate conductor is located within the tube. At this final point in the method, an end of the elongate conductor is adjacent each end of the tube.

11 Claims, 1 Drawing Sheet

METHOD OF MANUFACTURING A DOWNHOLE ELECTRICAL CABLE

BACKGROUND OF THE INVENTION

This invention relates to a method of manufacturing downhole electrical cable, particularly for use in providing electrical power and signals to downhole equipment.

In the hydrocarbon exploration and exploitation industry, there is a requirement to provide electrical signals from above ground and water to downhole equipment and subsea equipment.

One conventional method of manufacturing downhole electrical cable is to insert a leader wire into a steel tube. The leader wire is run through the length of the steel tube by pressuring the steel tube behind a piston head attached to the leader wire. When the leader wire has run through the entire length of the steel tube, the front of the leader wire is attached to a conducting wire, and the leader wire is pulled back through the steel tube, thus pulling through the conductor wire. Thus, the downhole electrical cable is formed.

However, there is a limitation on the length of steel tube through which the leader wire can be successfully pumped, as there are pressure losses over the length of the steel tube. Currently, the typical length requirement of downhole electrical cables is approximately 15,000 feet. With this method of manufacturing downhole electrical cable, it is normally not possible to produce any cables longer than this, as further increases in the fluid pressure may cause damage or failure of the steel tube.

It is also known to form the downhole electrical cable by seam welding the steel tube around the conductor. However, this has the disadvantage that the conductor, and insulating sheath that protects the conductor from the steel tube, may suffer degradation due to the heat produced by the seam welding process, which makes this existing method relatively expensive.

SUMMARY OF THE INVENTION

According to the present invention, there is provided a method of manufacturing a downhole electrical cable, the method comprising arranging an elongate member adjacent to a flat elongate sheet of material, the length of the elongate member being greater than the length of the flat elongate sheet; forming the elongate sheet into a cylindrical shape around the elongate meter; joining the adjacent longitudinal edges of the cylindrical shape to form the elongate sheet into a tube with an end of the elongate member adjacent each end of the tube; coupling an elongate conductor to one end of the elongate member; and pulling the other end of the elongate member to draw the elongate conductor through the tube until the elongate member is removed from the tube and the elongate conductor is located within the tube, an end of the elongate conductor being adjacent each end of the tube.

Preferably, when the elongate sheet Is formed into the tube, an end of the elongate member protrudes from each end of the tube.

Preferably, the adjacent longitudinal edges of the cylindrical shape are joined by seam welding the edges together.

The elongate conductor may comprise a conductor element and an external coaxial electrically insulating means, preferably in the form of a sheath, cover or coating.

Typically, a fluid barrier device is interposed between the elongate conductor and the tube.

The fluid barrier device may be a curable material, such that the curable material is, preferably, inserted into the annulus between the elongate conductor and the tube, and thereafter the curable member is cured.

Alternatively, the fluid barrier device may be a mechanical device, such that the mechanical device, preferably, forms a seal between the elongate conductor and the tube.

Preferably, the elongate conductor is locked with respect to the tube by a locking device.

Preferably, the fluid barrier device is the locking device.

BRIEF DESCRIPTION OF THE DRAWINGS

Embodiments of the invention will now be described, by way of example only, with reference to the accompanying drawings, in which.

DESCRIPTION OF THE PREFERRED EMBODIMENT

Figure 1:
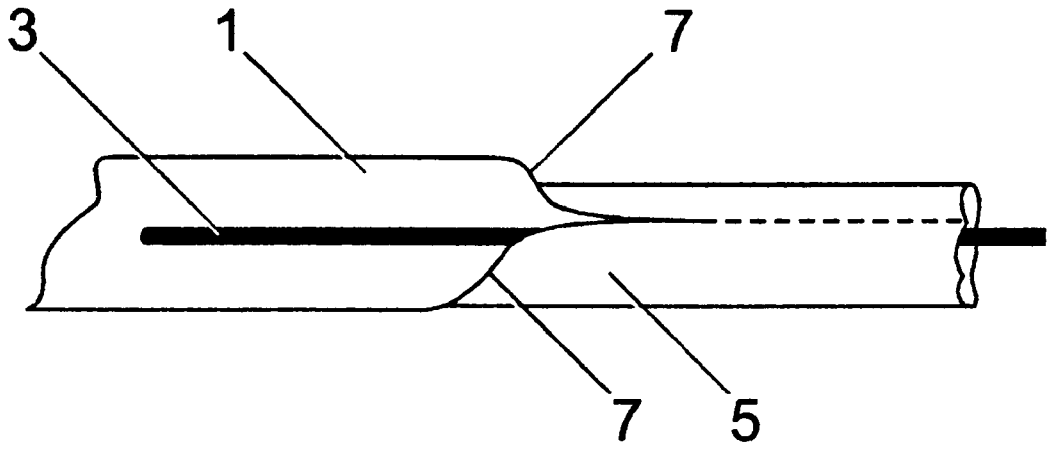
FIG. 1 is a perspective view of a tube being formed around a leader wire in accordance with the present invention.
Figure 2:
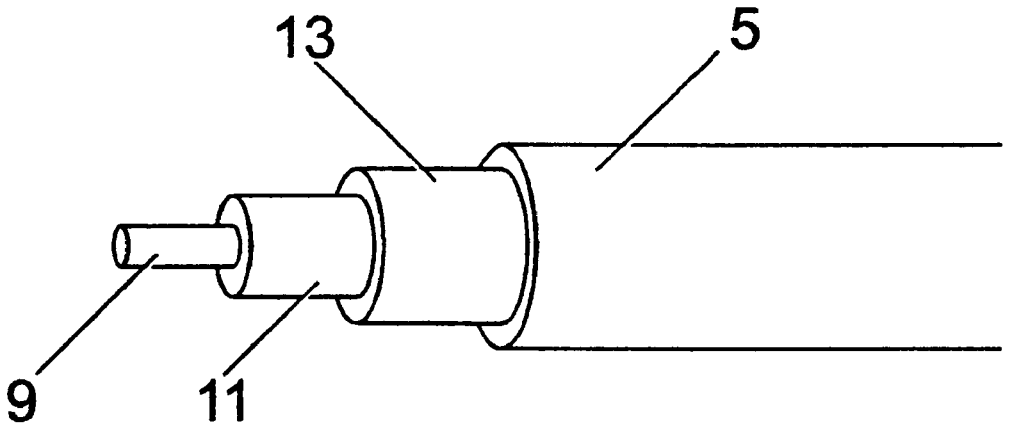
FIG. 2 is a perspective view of a downhole electrical cable which has been manufactured in accordance with the present invention.

FIG. 1 shows part of a length of flat steel 1 with a leader wire 3 being arranged in close proximity to it. The flat steel 1 is rolled to form a steel tube 5, and the steel tube 5 is sealed by seam welding the edges 7 of the flat steel 1 together. The flat steel 1 is formed into the steel tube 5 for the length required, which may typically be in the region of 15,000 feet or may be more. Accordingly, the steel tube 5 is formed along its entire length with the leader wire 3 located within the steel tube 5.

One end (not shown) of the leader wire 3 is attached to a conductor element 9 A sheath 11 encapsulates the conductor element 9 in order to protect the conductor element 9.

The other end of the leader wire 3 is pulled away from the steel tube 5, and hence the rest of the leader wire 3, and the conductor element 9 and sheath 11 are drawn through the steel tube 5. The conductor element 9 and sheath 11 are pulled all the way through the steel tube 5.

An important aspect of drawing the leader wire 3, and hence the conductor element 9 through the steel tube 5, is that the steel tube 5 is laid out flat prior to drawing the leader wire 3 through the steel tube 5.

It is desirable to provide fluid barrier between the conductor element 9 and the inside of the steel tube 5. A curable material 13 such as epoxy resin is injected down the steel tube 5 and is thereafter cured. The epoxy resin provides a fluid barrier in the annulus between the sheath 11 and the inside of the steel tube 5. Therefore, equipment located above the curable material 13 is isolated from fluid located below the curable material 13, and vice versa An alternative to the curable material 13 for providing a fluid barrier in the annulus between the outer surface of the sheath 11 and the inner surface of the steel tube 5 is a mechanical fluid barrier, that could be inserted into the annulus.

It is also desirable that the conductor element 9 is locked with respect to the steel tube 5, as users of downhole electrical cables may perceive that tension may be placed on the conductor element 9 if it is not locked to the steel tube 5. This may lead to the conductor element 9 breaking away from its connection at the uppermost part of the downhole electrical cable, when the cable is used, in particular, in a vertical manner.

By injecting the curable material 13 into the annulus between the sheath 11 and the inside of the steel tube 5, the conductor element 9 is locked in place.

An alternative locking arrangement of the conductor element 9, may be used in place of the curable material. For example, such an alternative is a helical spring mechanism (not shown) which is wrapped around the conductor element 9 and is actuated in order to lock the conductor element 9 with respect to the steel tube 5.

Modifications and improvements may be made to the embodiment without departing from the scope of the invention.

I claim:

1. A method of manufacturing a downhole electrical cable, the method comprising arranging an elongate member adjacent to a flat elongate sheet of material, the length of the elongate member being greater than the length of the flat elongate sheet; forming the elongate sheet into a cylindrical shape around the elongate member; joining the adjacent longitudinal edges of the cylindrical shape to form the elongate sheet into a tube with an end of the elongate member adjacent each end of the tube; coupling an elongate conductor to one end of the elongate member; and pulling the other end of the elongate member to draw the elongate conductor through the tube until the elongate member is removed from the tube and the elongate conductor is located within the tube, an end of the elongate conductor being adjacent each end of the tube.

2. A method of manufacturing downhole electrical cable according to claim 1, wherein when the elongate sheet is formed into the tube, an end of the elongate member protrudes from each end of the tube.

3. A method of manufacturing downhole electrical cable according to claim 1, wherein the adjacent longitudinal edges of the cylindrical shape are joined by seam welding the edges together.

4. A method of manufacturing downhole electrical cable according to claim 1, wherein the elongate conductor further comprises a conductor element and an external coaxial electrically insulating means.

5. A method of manufacturing downhole electrical cable according to claim 1, wherein a fluid barrier device is interposed between the elongate conductor and the tube.

6. A method of manufacturing downhole electrical cable according to claim 5, wherein the fluid barrier device is a curable material.

7. A method of manufacturing downhole electrical cable according to claim 6, wherein the curable material is inserted into the annulus between the elongate conductor and the tube, and thereafter the curable member is cured.

8. A method of manufacturing downhole electrical cable according to claim 5, wherein the fluid barrier device is a mechanical device.

9. A method of manufacturing downhole electrical cable according to claim 8, wherein the mechanical device forms a seal between the elongate conductor and the tube.

10. A method of manufacturing downhole electrical cable according to claim 5, wherein the elongate conductor is locked with respect to the tube by a locking device.

11. A method of manufacturing downhole electrical cable according to claim 10, wherein the fluid barrier device is the locking device.

* * * * *